US006037040A

United States Patent [19]

Ohi et al.

[11] Patent Number: 6,037,040

[45] Date of Patent: Mar. 14, 2000

[54] LIGHT-TRANSMITTING RECORDING MATERIAL FOR ELECTROPHOTOGRAPHY, AND HEAT FIXING METHOD

[75] Inventors: Takehiko Ohi, Yokohama; Naoki Kushida, Hachioji; Yomishi Toshida, Yokohama; Hiroyuki Ogino, Tokyo, all of Japan

[73] Assignee: Canon Kabushiki Kaisha, Tokyo, Japan

[21] Appl. No.: 08/763,633

[22] Filed: Dec. 4, 1996

[30] Foreign Application Priority Data

Dec. 8, 1995 [JP] Japan ..... 7-345732

[51] Int. Cl.[7] ..... G03G 7/00

[52] U.S. Cl. ..... 428/195; 428/264; 428/913; 428/914; 428/411.1; 428/212; 427/195; 427/212

[58] Field of Search ..... 428/195, 264, 428/913, 914, 411.1, 212; 427/212, 195

[56] References Cited

U.S. PATENT DOCUMENTS 5,301,439 4/1994 Malhotra et al. ..... 428/195

FOREIGN PATENT DOCUMENTS 0 675 178 10/1995 European Pat. Off. .

OTHER PUBLICATIONS

Patent Abstracts of Japan, vol. 010, No. 242 (M–509), Aug. 21, 1986 & JP 61–072581A (Canon Inc.), Apr. 14, 1986.

*Primary Examiner*—Richard Weisberger
*Attorney, Agent, or Firm*—Fitzpatrick, Cella, Harper & Scinto

[57] ABSTRACT

A light-transmitting recording material for electrophotography is disclosed which has a light-transmitting base material and a surface layer. The surface layer contains a thermoplastic resin and a release agent having a melting point of from 40° C. to 120° C. Also, a heat fixing method is provided in which a toner image is formed and heat-fixed on the above light-transmitting recording material.

32 Claims, 3 Drawing Sheets

LIGHT-TRANSMITTING RECORDING MATERIAL FOR ELECTROPHOTOGRAPHY, AND HEAT FIXING METHOD

BACKGROUND OF THE INVENTION

1. Field of the Invention

This invention relates to an electrophotographic light-transmitting recording material on which toner images are formed, and a heat fixing method by which the toner images are fixed on the recording material.

2. Related Background Art

In a typicalfull-color toner image forming method conventionally available, a photosensitive material of a photosensitive drum is electrostatically uniformly charged by a primary corona assembly, and is imagewise exposed using laser light modulated by magenta image signals of an original, to form an electrostatic latent image on the photosensitive drum. The electrostatic latent image is developed by means of a magenta developing assembly to form a magenta toner image on the photosensitive drum. Then, to a recording material transported there, the magenta toner image formed on the photosensitive drum is transferred by means of a transfer corona assembly.

Next, the photosensitive drum on and from which the electrostatic image has been developed and has been transferred is destaticized by means of a charge eliminating charging assembly, and is then cleaned. Thereafter, it is again electrostatically charged by the primary corona assembly, and a cyan toner image is similarly formed on the photosensitive drum. The cyan toner image is transferred to the recording material on which the magenta toner image has been transferred, and then a yellow toner image and a black toner image are further successively formed and developed so that the four color toner images are transferred to the recording material. The recording material having the four color toner images formed thereon is fed to a fixing means such as a fixing roller so that they are fixed to the recording material by the action of heat and pressure. Thus, a full-color image is formed.

In recent years, such image forming apparatus are not only used as copying machines for office work to make copies of originals, but also has begun to be used in the field of printers serving as outputs of computers and in the field of personal copying in private use. In addition to such field as typified by laser beam printers, the apparatus are also being applied in plain-paper facsimile machines employing a basic image forming apparatus.

Under such circumstances, the image forming apparatus as described above are sought to be made smaller, lighter, faster, of better quality and more reliable. Such machines have now been constituted of simpler components in various respects. As the result, a higher performance has become required for toners, and superior machines can no longer be accomplished unless an improvement in the performance of toners is achieved.

In recent years, the need for various modes of copying is accompanied with a rapid increase in demand for color copying. In order to more faithfully copy original color images, it is sought to achieve a much higher image quality and a much higher resolution. From such viewpoints, the toners used in the color image forming method are required to have good melt properties and color-mixing properties when heat is applied, and also to have a low melting point and high sharp-melt properties. Use of such toners having high sharp-melt properties makes it possible to broaden the range of color reproduction of copied images and obtain color copies faithful to original images.

Such a toner having high sharp-melt properties, however, has so high an affinity for the fixing roller that it tends to offset to the fixing roller during fixing. In particular, in the case of a fixing means in full-color image forming apparatus, an increase in toner layer thickness more tends to cause the offset since a plurality of toner layers corresponding to magenta toner, cyan toner, yellow toner and black toner are formed on the recording material.

In order to improve the releasability of toner from the surface of the fixing roller, a measure has been conventionally taken such that the roller surface is formed of a material such as silicon rubber or a fluorine resin, having an excellent releasability to toner, and, in order to prevent offset and to prevent fatigue of the roller surface, its surface is further covered with a thin film formed using a fluid having a high releasability as exemplified by silicone oil or fluorine oil. However, this method, though effective in view of the prevention of the offset of toner, requires a device for feeding an anti-offset fluid, and hence has the problem that the fixing assembly becomes complicated. Also, this application of oil brings about the problem that it causes separation of layers constituting the fixing roller to consequently acceleratedly shorten the lifetime of the fixing roller.

The need in recent years for various modes of copying is also accompanied by the use of paper of various types, coated paper, plastic films and so forth as recording materials. In particular, need for light-transmitting sheets (OHP sheets) has attracted notice, which make use of an overhead projector (OHP) for its presentation. Especially in the case of the OHP sheets, as different from paper, the oil used in the above fixing assembly may adhere to the surface of the recording material because of their low oil absorption capacity. As the result, the OHP sheets on which images have been formed can not avoid having a sticky feeling because of the oil coated thereon, to cause a lowering of image quality. Also, the release oil such as silicone oil may evaporate by heat to contaminate the interior of image forming apparatus, and also has a possibility of causing the problem of disposal of recovered oil.

Accordingly, much hope has been put in the establishment of a fixing system that requires no application of oil in the course of fixing and the development of a novel toner for achieving its establishment, having solved the above problems.

To cope with the above subject, Japanese Patent Application Laid-open No. 61-273554 discloses a toner containing a release agent such as wax. The toner containing the wax brings about an improvement in heat conductivity in toner on account of the wax that melts at a low temperature, so that it enables low-temperature fixing. As a more preferable feature, the wax having melted at the time of fixing acts also as a release agent, and hence it becomes possible to prevent high-temperature offset without applying a separate release agent such as oil to the fixing roller.

When color toner images or full-color toner images are formed on the light-transmitting sheet by using an electrophotographic system having a dry development system and the images formed are projected using an OHP, a phenomenon may occur in which, even though the images on the light-transmitting sheet show a satisfactory color formation, the projected images have a grayish tone as a whole to give a very narrow range of color reproduction. This phenomenon occurs because unfixed toner images formed on a smooth light-transmitting sheet can not be melthed properly by the heating in the course of fixing and remain particulate, to cause scattering of incident light and form a shade on the screen. In particular, in halftone areas or highlight areas having a low image density, the absorption ascribable to a dye or pigment in the toner becomes lower because of a decrease in the number of toner particles, so that a phenomenon may occur in which the color tone to be reproduced is grayish.

On the other hand, in the case when toner images formed on recording materials such as plain paper are viewed, reflected images of light shed on fixed toner images are viewed. Hence, the toner surface remaining more or less particulate may have less influence on image quality. However, in the case when toner images are viewed through transmitted light or projected on screens as in OHPs, light transmission properties may become poor because of scattering of light if any residual shape ascribable to toner particles is distinctive. Accordingly, recording materials used in OHPs are required to be effective for making the toner less particulate after the fixing to improve light transmission properties.

Accordingly, as recording materials for electrophotography, light-transmitting recording materials comprising a transparent base sheet provided thereon with a surface layer formed of a thermoplastic resin such as styrene-acrylic resin or polyester resin are hitherto proposed in variety, from the viewpoint of the improvement in sharpness and improvement in transport performance and blocking resistance that are attributable to an improvement in the fixing performance of toners. For example, Japanese Patent Applications Laid-open No. 1-263085, No. 6-19180, No. 6-19485 and No. 6-332221 disclose such recording materials. Also, as a means for making toners less particulate after fixing to improve light transmission properties, a method is used in which toner particles are buried in the surface layer by the action of the heat and pressure at the time of fixing, as disclosed in Japanese Patent Applications Laid-open No. 2-263642 and No. 7-199515. In these light-transmitting recording materials, the toner is made less particulate after fixing as an effect attributable to the resin constituting the surface layer, and hence they are improved in light transmission properties to have superior projection performance on OHPs. When, however, there is used a resin that can not be well plasticized by the action of the heat and pressure at the time of fixing, the toner particles enter in the surface layer in a very small quantity, so that projected images may have a grayish tone.

The fixing devices described above are all of the type that a release agent such as oil is applied to the fixing roller so that it can be put into service when toner images are fixed. That is, the OHP sheets referred to in the above take no account of an oil-less fixing process, which uses a toner containing wax as a release agent and requires no application of the release agent such as oil to the surface of the fixing roller. Hence, especially when toner images having a small quantity of toner, having an image area percentage of about 5%, are heat-fixed on the above OHP sheets using the toner described above, the toner shows good anti-offset properties at toner image areas because the wax contained in the toner acts as the release agent. However, the wax does not well act as the release agent at areas where the toner images are not formed in a wide range, and hence a phenomenon tends to occur in which the surface layer formed of the thermoplastic resin sticks to the fixing roller. Thus, the recording materials are sought to be improved so as to be suited for the oil-less fixing process making use of the above toner.

Japanese Patent Application Laid-open No. 5-181300 discloses that a toner containing a wax component is heat-fixed to a transparent recording material by the oil-less fixing process in which the release agent such as oil is not applied to the surface of the fixing roller. This publication, however, does not teach at all the fixing of the toner images having a small quantity of toner, having an image area percentage of about 5%.

SUMMARY OF THE INVENTION

An object of the present invention is to provide a light-transmitting recording material for electrophotography, that has solved the problems discussed above, and a toner image heat fixing method that employs such a recording material.

Another object of the present invention is to provide a light-transmitting recording material for electrophotography, on which, when used in an overhead projector (OHP), projected images can be formed as color images or full-color images having a good color tone reproducibility without being grayish at halftone areas and highlight areas having especially a low image density; and a toner image heat fixing method that employs such a recording material.

Still another object of the present invention is to provide a light-transmitting recording material for electrophotography, having a surface layer that can be free from sticking to the surface of a fixing means when toner images are fixed, without regard to whether the toner images are those formed by a toner incorporated with a wax or they are fixed by a fixing means making use of no oil; and a toner image heat fixing method that employs such a recording material.

A further object of the present invention is to provide a light-transmitting recording material for electrophotography, that can provide a color or full-color transparent sheet having a superior transparency and a good quality; and a toner image heat fixing method that employs such a recording material.

The present invention provides a light-transmitting recording material for electrophotography, comprising a base material and a surface layer formed on the base material, wherein the surface layer contains a thermoplastic resin and a release agent the release agent having a melting point of from 40° C. to 120° C. and the light-transmitting recording material has a total light ray transmittance of at least 80% and a haze of no more than 10.

The present invention also provides a heat fixing method comprising forming a toner image on a light-transmitting recording material by the use of a toner, and heat-fixing the toner image to the light-transmitting recording material by a heat fixing means, wherein;

the light-transmitting recording material comprises a light-transmitting base material and a surface layer formed on the base material;

the surface layer containing a thermoplastic resin and a release agent having a melting point of from 40° C. to 120° C.

DESCRIPTION OF THE PREFERRED EMBODIMENTS

The present inventors have made extensive studies in order to solve the problems involved in the prior art. As a result, they have discovered that a light-transmitting recording material for electrophotography that can be well released from a heat fixing means and also does not adversely affect toner image fixing performance can be obtained when the surface layer (a toner-receiving layer) of the light-transmitting recording material is formed using a mixture mainly composed of a thermoplastic resin and a release agent having a specific melting point. Thus, they have accomplished the present invention. More specifically, the light-transmitting recording material for electrophotography according to the present invention can be well released from a heat fixing means without sticking to the surface of the heat fixing means even when no oil is additionally fed to the heat fixing means in a large quantity, and images obtained are not grayish and can be high-quality images also having a superior transparency.

An example of the light-transmitting recording material of the present invention, constituted as described above, will be described below with reference to FIG. 1.

Figure 1:
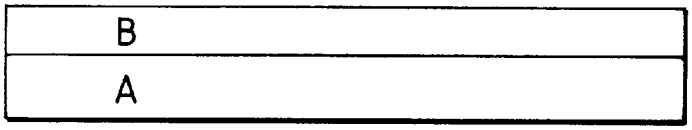
FIG. 1 cross-sectionally illustrates the constitution of the light-transmitting recording material of the present invention.

In FIG. 1, letter symbol A denotes a transparent base sheet made of resin which serves as a base material layer, and B, a light-transmitting surface layer. The base sheet must have a heat resistance high enough to cause no serious thermal deformation upon heating at the time of heat fixing or heat-and-pressure fixing. The base sheet used in the present invention may preferably be a base sheet having a thermal deformation temperature of 145° C. or above, and more preferably 150° C. or above, under measuring conditions of 4.6 kg/cm$^2$ as prescribed in ASTM D684. The base sheet used in the present invention may more specifically be formed of a material including resins having a thermal deformation temperature of 145° C. or above under the above measuring conditions and also having a heat resistance of 100° C. or above as a maximum service temperature, as exemplified by polyethylene terephthalate (PET), polyester, polyamide and polyimide. In particular, polyethylene terephthalate is preferred in view of heat resistance and transparency.

The base sheet formed of the material as described above must have a thickness large enough not to form wrinkles when the sheet becomes soft upon heating at the time of the fixing of toner images. For example, in the case of polyethylene terephthalate, it may have a thickness of at least 50 $\mu$m. Even for such a light-transmitting sheet, an increase in thickness results in a decrease in light transmittance, and hence the base sheet used may preferably have a thickness of from 50 to 300 $\mu$m, more preferably from 70 to 200 $\mu$m, and still more preferably from 100 to 150 $\mu$m, in approximation.

In the light-transmitting recording material of the present invention, the surface layer B formed on the base material layer A as described above contains a thermoplastic resin and a release agent having a specific melting point. In the present invention, as methods for forming the surface layer, it may be formed by a method in which a coating solution containing the thermoplastic resin and the release agent, prepared by dissolving them in an organic solvent or dispersing them in water as an aqueous solution or dispersion, is coated on the surface of the light-transmitting base sheet by a coating process such as bar coating, dip coating, spray coating or spin coating. It is preferable to further make surface treatment such as plasma treatment or corona discharge treatment or form an adhesive layer between the heat-resistant resin base sheet and the surface layer so that the adhesion between the both can be improved.

In the present invention, a resin usable to form the adhesive layer may include, e.g., adhesive resins such as polyester resins, acrylate resins, methacrylate resins, styrene-acrylate copolymers and styrene-methacrylate copolymers.

The materials constituting the surface layer of the light-transmitting recording material of the present invention will be described in detail. The thermoplastic resin used in the surface layer B in the present invention will be described.

There are no particular limitations on the thermoplastic resin used in the surface layer. For example, it may include a variety of thermoplastic resins such as polyester resins, polymethyl methacrylate resins, acrylic resins, styrene resins, styrene-acrylic resins, rubber resins, epoxy resins, vinyl chloride resins, vinyl acetate resins and polyurethane resins, and any of those in which a cross-linking agent is used.

The thermoplastic resin may preferably have a number average molecular weight within the range of from 3,000 to 500,000, and more preferably from 5,000 to 200,000. If it has a number average molecular weight less than 3,000, the surface layer tends to stick to the surface of the fixing means. If the resin has a number average molecular weight more than 500,000, the surface layer may have insufficient softening properties at the time of heat fixing, and it may be not effectively done to bury toner particles in the surface layer to make the toner less particulate, resulting in a lowering of image characteristics. Also, the coating solution used when the surface layer is formed may have so high a viscosity that the coating solution has low coating properties, resulting in a lowering of workabilitiy.

In the present invention, the number average molecular weight of the thermoplastic resin is determined from molecular weight distribution as measured by GPC (gas permeation chromatography).

The measurement by GPC is made using GPC-150C (manufactured by Waters Co.) under the following conditions. Columns are stabilized in a heat chamber of 40° C. To the columns kept at this temperature, THF (tetrahydrofuran) as a solvent is flowed at a flow rate of 1 ml per minute. A THF sample solution of resin is prepared in a sample concentration of 0.05 to 0.6% by weight, and 50 to 200 $\mu$l of the sample solution obtained is injected to make measurement. In measuring the molecular weight of the sample, the molecular weight distribution ascribed to the sample is calculated from the relationship between the logarithmic value and count number of a calibration curve prepared using several kinds of monodisperse polystyrene standard samples. As the standard polystyrene samples used for the preparation of the calibration curve, samples with molecular weights of from $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$ are used, which are standard polystyrene samples commercially available from Toso Co., Ltd. An RI (refractive index) detector is used as a detector. Columns are used in combination of TSKgel, G1000H, G2000H and G3000H, available from Toso Co., Ltd.

The thermoplastic resin used in the present invention may preferably have a glass transition temperature (Tg) within the range of from −10° C. to 80° C., more preferably from 0° C. to 70° C., and still more preferably from 20° C. to 70° C., as measured by DSC (differential scanning calorimetry). If the thermoplastic resin has a glass transition temperature lower than −10° C., sticking to the fixing roller may occur, or blocking tends to occur to cause a decrease in storage stability. If it has a glass transition temperature higher than 80° C., the surface layer may have insufficient softening properties at the time of heat fixing, and it may be less effectively done to bury toner particles in the surface layer to make the toner less particulate.

In the present invention, the glass transition temperature (Tg) is measured by DSC, using an internal heating input compensation type differential scanning calorimeter. As the measuring device, DSC-7, manufactured by Perkin-Elmer Inc., may be used. The measurement is made according to ASTM D3418-82. In the present invention, a sample to be measured is precisely weighed in a quantity of 5 to 20 mg, and preferably 10 mg. This sample is put in an aluminum pan. Using an empty aluminum pan as a reference, the measurement is made in an environment of nitrogen at temperatures ranging from −100° C. to 200° C., raised at a rate of 10° C./min. In the present invention, during this temperature rise, base lines before and after the base lines are shifted are extrapolated in the mutual direction, and the point at which the line at a middle point of the base lines and the differential thermal curve intersect is regarded as Tg.

The transparent surface layer constituting the light-transmitting recording material of the present invention is formed chiefly of the thermoplastic resin as described above and the release agent having a specific melting point. The release agent will be detailed below.

The release agent used in the present invention is characterized by having a melting point preferably within the range of from 40° C. to 120° C., and more preferably within the range of from 50° C. to 120° C. If the release agent has a melting point lower than 40° C., the resulting light-transmitting recording material tends to cause blocking during its storage, resulting in a poor storage stability. If it has a melting point higher than 120° C., the recording material can not be well releasable from the fixing means, and also the molten toner and the surface layer may insufficiently melt at the time of the fixing of toner images, so that irregular reflection caused at their boundary surfaces may undesirably cause a lowering of image characteristics of the resulting light-transmitting recording material.

Figure 4:
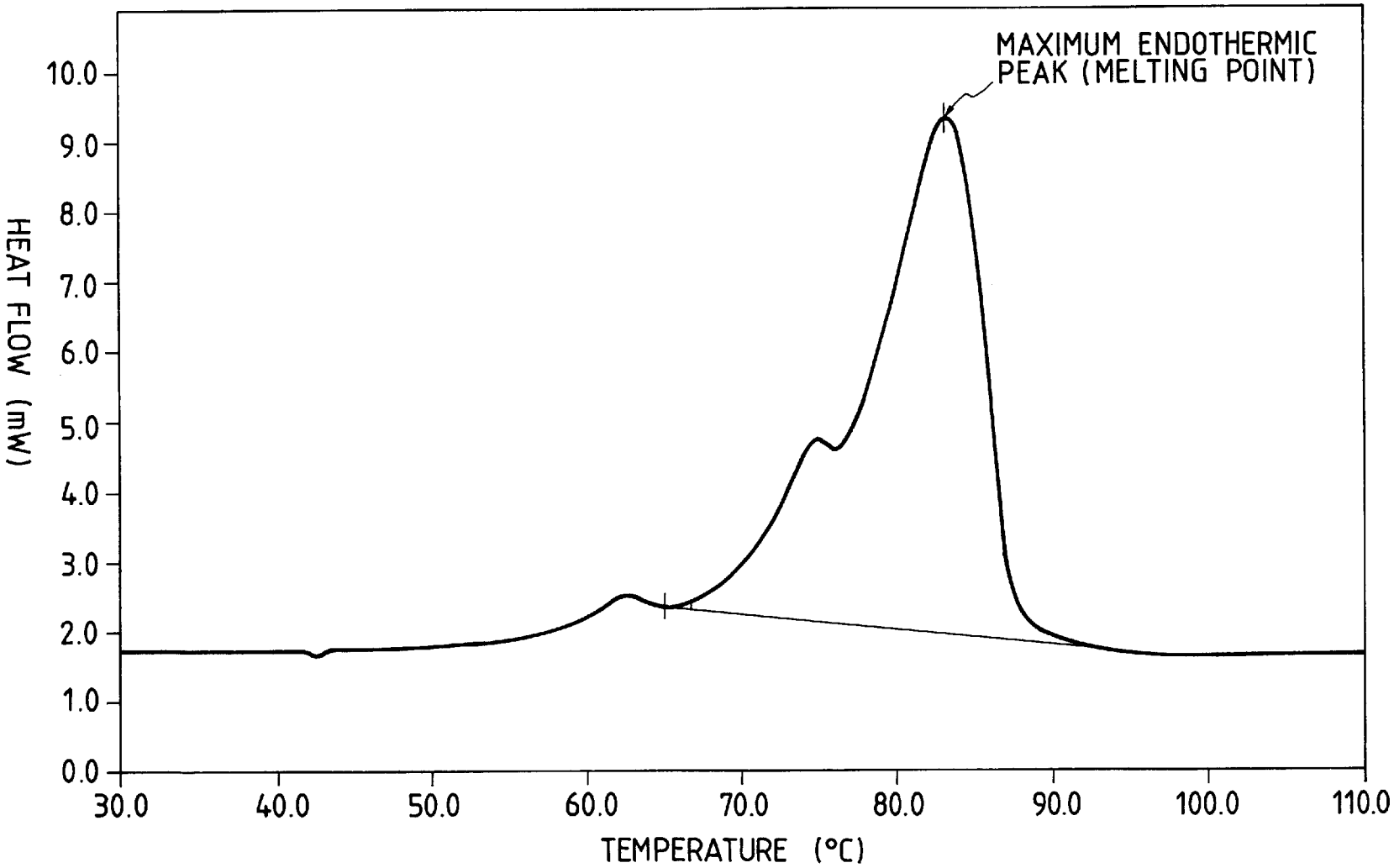
FIG. 4 is a graph showing the DSC curve of a release agent used in Example 10.

In the present invention, the melting point is measured by DSC. Stated specifically, the measurement by DSC is made using DSC-7, manufactured by Parkin Elmer Co., and according to ASTM D3418-82. In the present invention, as the DSC curve used here, a DSC curve is used which is measured when the temperature of a sample is once raised to previously take a history and thereafter the temperature is dropped and again raised at a temperature rate of 10° C./min. As shown in FIG. 4, the maximum endothermic peak temperature in the the DSC curve at the time of temperature rise from −100° C. to 200° C. is regarded as the melting point.

The release agent used in the present invention, having the above melting point, may include waxes as exemplified by vegetable waxes such as carnauba wax, candelilla wax, rice wax and Japan wax, and derivatives of these; mineral waxes such as ceresine wax and montan wax, and derivatives of these (e.g., derivatives of montan wax include acid wax, ester wax, and partially saponified esterified wax); animal waxes such as beeswax, spermaceti and lanolin, and derivatives of these; petroleum waxes such as paraffin wax and microcrystalline wax, and derivatives of these; synthetic waxes such as polyethylene wax and Fischer-Tropsch wax, and derivatives of these. Besides, higher fatty acids such as lauric acid, myristic acid, palmitic acid, stearic acid and behenic acid; higher alcohols such as stearyl alcohol and behenyl alcohol; esters such as fatty acid esters of saccharide and fatty acid esters of sorbitan; and amides such as oleyl amide may be used in combination with the above waxes.

The release agent used in the present invention may preferably maintain the state of fine particles in the surface layer in combination with the thermoplastic resin and also do not damage the transparency of the recording material.

For this purpose, as the release agent used in the present invention, the release agent present in the surface layer may preferably have an average dispersion diameter smaller than 1 μm, more preferably within the range of from 0.01 μm to smaller than 1.00 μm, and still more preferably within the range of from 0.04 μm to 0.50 μm. If in the surface layer the release agent has an average dispersion diameter of 1 μm or larger, the transparency of the surface layer may be damaged.

In the present invention, the release agent in the surface layer may be completely dissolved in the thermoplastic resin, and may be present in the surface layer in that state. In order for the recording material to well efficiently exhibit release properties on account of the addition of the release agent, the release agent may preferably be used in such a state that it keeps an average dispersion diameter of 0.01 μm or larger in the surface layer.

In the present invention, in order to make the release agent present in the surface layer in the state of fine particles having an average dispersion diameter of smaller than 1 μm, it is preferable to form the surface layer in the following way: A coating solution is prepared in which the release agent already has an average dispersion diameter of smaller than 1.00 μm when the coating solution used to form the surface layer is prepared, and the resulting coating solution is coated on the light-transmitting base sheet, followed by drying to form a film. In the present invention, it is more preferable to control temperature conditions for the drying to form a film, so as to be a temperature not lower than the Tg of the thermoplastic resin and a temperature within plus-minus 40° C. of the melting point of the release agent.

The release agent used in the present invention may, in general, dissolve in organic solvents with difficulty especially at room temperature, and can be used in solvent systems with difficulty. Hence, it is preferable to previously prepare an aqueous dispersion of the release agent, and mix this aqueous dispersion with an aqueous dispersion of the thermoplastic resin to obtain a coating solution, which coating solution is applied to form the surface layer on the light-transmitting base sheet.

Here, methods preferable for obtaining the aqueous dispersion of the release agent may include, e.g., (1) a method in which the release agent in a molten state is added little by little in water heated to a temperature about the melting point of the release agent while stirring it at 5,000 rpm by means of a homomixer, and (2) suspension polymerization.

When the aqueous dispersion of the release agent, thus obtained, is mixed with the aqueous dispersion of the thermoplastic resin, it is preferable to control conditions such as temperature and solid matter concentration so that the aqueous dispersion of the thermoplastic resin has a viscosity of 200 cps or below. If the aqueous dispersion of the thermoplastic resin has a viscosity higher than 200 cps, when mixed with the aqueous dispersion of the release agent, the finely dispersed particles of the release agent may agglomerate one another, thus such a viscosity is not preferable.

In the surface layer thus formed, the fine particles of the release agent are uniformly dispersed in the thermoplastic resin. Thus, it is presumed that the release agent melts and moves to the surface of the surface layer when it is passed through the heat fixing means, to bring about the release effect.

The content of the release agent used to form the surface layer may more or less vary depending on the thickness of the surface layer. It may preferably be within the range of from 0.01% by weight to 30% by weight, and more preferably form 0.1% by weight to 30% by weight, based on the total weight of the surface layer. If the release agent is in a content less than 0.01% by weight, no sufficient release effect can be obtained, and if it is in a content more than 30% by weight, the release agent may become deposited to damage the transparency of the surface layer, undesirably.

The materials used in the release agent as described above commonly have a crystallizability, and greatly tend to cause a decrease in transparency especially when they have a high crystallizability. The present inventors have discovered that the transparency is improved without regard to the type of materials when materials having a specific relationship between the Tg of the thermoplastic resin constituting the surface layer and the melting point of the release agent also constituting the same are selected and used. More specifically, the melting point of the release agent may preferably be higher by at least 10° C., and more preferably at least 20° C., than the glass transition temperature (Tg) of the thermoplastic resin. When the surface layer of the light-transmitting recording material is formed using materials in such a combination, the transparency of the recording material is improved. The reason therefor is unclear, and is presumed to be as follows: At the time when fine crystals are formed upon cooling of the release agent at the surface of the surface layer after the recording material is passed through the heat fixing roller, the melting point of the release agent is on the side of somewhat higher temperature than the glass transition temperature (Tg) of the thermoplastic resin, where the microbrownian movement of the thermoplastic resin causes a waver which affects the release agent to cause a decrease in its crystallizability to bring about the improvement.

If the melting point of the release agent is not higher by at least 10° C. than the glass transition temperature (Tg) of the thermoplastic resin, the decrease in crystallizability is not so effectively achieved to make it difficult to contribute to the transparency of the recording material.

In the present invention, the melting point of the release agent may preferably be higher by at most 120° C. than the glass transition temperature (Tg) of the thermoplastic resin. If the melting point of the release agent is higher by above 120° C. than the glass transition temperature (Tg) of the thermoplastic resin, sticking to the fixing roller may occur at the fixing temperatures of the toner, or blocking tends to occur to cause a decrease in storage stability.

Under the constitution as described above, the thermoplastic resin used in the present invention can have a softening temperature closed to, or lower than, the fixing temperature of the toner. Hence, the toner can be readily buried in the surface layer and, as previously stated, the toner can be made less particulate, so that the smoothness of the image surface is improved and the transparency of the resulting recording material is improved.

In the present invention, the surface layer may preferably have a thickness of from 2 to 30 $\mu$m, and more preferably from 3 to 15 $\mu$m, where optimum thickness may vary depending on the particle diameter of the toner to be fixed. The optimum thickness of the surface layer is also limited by requirements for transparency and prevention of unclear images. Since, however, the surface layer has a flexibility, there is no possibility of cracking of images even if it has a large thickness.

In the formation of the surface layer using the constituent materials as described above, it is preferable to mix an antistatic agent (as a surface resistivity modifier) in, or coat it on, the surface layer so that the surface resistivity is controlled to be $10^7$ to $10^{13}$ Ω/square which are within the range of the surface resistivity suited for the transfer of toner.

In the present invention, the surface resistivity is measured according to JIS K-6911. In the present invention, it is measured at 20° C., 6% RH and a voltage of 100 V, using R8340A and R12702A, manufactured by Advantest Co.

As the antistatic agent used in the present invention, any conventionally known agents may be used, including, e.g., tertiary ammonium salt compounds, pyridinium salt compounds, phosphonium salt compounds, alkylbetaine compounds, alkylimidazoline compounds, alkylalanine compounds, polyoxyethylene type nonionic compounds, polyhydric alcohol type nonionic compounds, conductive resins such as polyvinylbenzyl type cationic resins and polyacrylic acid type cationic resins, and ultrafine particles of metal oxides such as $SnO_2$ and $SnO_2$-Sb. Any of these antistatic agents can be mixed in the coating solution used when the surface layer is formed, so as to be simultaneously coated, or the antistatic agent can be dissolved in a solvent such as alcohol and the solution obtained can be coated to form an antistatic layer.

The light-transmitting recording material for electrophotography according to the present invention is required to have a good transparency. It may preferably have a light transmittance of at least 80%, and more preferably at least 85%, in terms of total light ray transmittance as an OHP sheet, and may also preferably has a haze of 10 or less, more preferably 7 or less, and still more preferably 3 or less. In the present invention, the transparency is measured according to JIS K-7105.

The heat fixing method of the present invention can be applied to all of electrophotographic systems making use of toner, such as color copying machines, color printers, color facsimile machines. The heat fixing method of the present invention may preferably be applied to a heat fixing means in which a release agent such as oil is not applied on its fixing member. It may also be applied to electrophotographic systems employing conventional heat fixing means in which toners prepared by a conventional pulverization process are used and a release agent such as oil is additionally applied on its fixing member.

The toner used in the heat fixing method of the present invention is constituted as described below.

The toner used in the heat fixing method of the present invention may preferably contain a wax component so that it is applied to the oil-less fixing process or a fixing process in which oil is applied in a small quantity.

The wax component serving as a release agent, contained in the toner used in the present invention, may include, e.g., paraffin waxes, polyolefin waxes and modified products thereof (e.g., oxides or grafted products), higher aliphatics and metal salts thereof, and amide waxes, but without being limited to these at all.

In the present invention, the wax component the toner may contain may preferably be in a content of from 1 to 50 parts by weight, and more preferably from 5 to 45 parts by weight, based on 100 parts by weight of the binder resin of the toner. If the wax component the toner may contain is in a content less than 1 part by weight, a sufficient releasability of the toner can be obtained with difficulty when applied to the oil-less fixing process or the fixing process in which oil is applied in a small quantity, and a phenomenon of offset may occur. If it is in a content more than 50 parts by weight, blocking resistance and storage stability of the toner may decrease.

The toner containing the wax component may be produced by either toner production process, a polymerization toner production process in which toner particles are produced by polymerization of a monomer composition containing at least a polymerizable monomer, the wax component and a colorant, or a pulverization toner production process in which toner particles are produced by melt kneading toner constituent materials containing at least a binder resin, the wax component and a colorant, followed by pulverization and classification.

In the present invention, the polymerization toner production process, in particular, a suspension polymerization toner production process in which toner particles are produced by suspension polymerization of the above monomer composition in an aqueous medium is preferred because the wax component can be incorporated in the toner in a larger quantity.

The polymerizable monomers usable in the above polymerization toner may include monomers as exemplified by styrene monomers such as styrene, o-methylstyrene, m-methylstyrene, p-methylstyrene, p-methoxystyrene and p-ethylstyrene; acrylates such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and other monomers such as acrylonitrile, methacrylonitrile and acrylamide.

Any of these monomers may be used alone or in combination of two or more kinds. Of the above monomers, it is preferable from the viewpoint of developing performance and running performance of the toner to use styrene or styrene derivatives alone or in combination with other monomer(s).

In the case when the toner is produced by the pulverization toner production process, the polymer used as the binder resin of the toner may include acids such as acrylic acid, methacrylic acid and maleic acid, and esters thereof; and resins obtained by polymerizing a monomer, such as polyester, polysulfonate, polyether and polyurethane, or resins obtained by copolymerizing two or more of these monomers; any of which may be used.

As the colorant contained in the toner used in the present invention, known colorants may be used, including, e.g., dyes such as carbon black, black iron oxide, C.I. Direct Red 1, C.I. Direct Red 4, C.I. Acid Red 1, C.I. Basic Red 1, C.I. Mordant Red 30, C.I. Solvent Red 49, C.I. Solvent Red 52, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4 and C.I. Basic Green 6; and pigments such as chrome yellow, cadmium yellow, mineral first yellow, navel yellow, Naphthol Yellow S, Hanza Yellow G, Permanent Yellow NCG, Tartrazine Lake, molybdenum orange, Permanent Orange GTR, Benzidine Orange G, cadmium red, Permanent Red 4R, Watchung Red calcium salt, Brilliant Carmine 3B, Fast Violet B, Methyl Violet Lake, prussian blue, cobalt blue, Alkali Blue Lake, Victoria Blue Lake, quinacridone, disazo type yellow pigments, Phthalocyanine Blue, Fast Sky Blue, Pigment Green B, Malachite Green Lake and Final Yellow Green G. When in the present invention the toner is obtained by polymerization, attention must be paid to the polymerization inhibitory action and aqueous-phase transfer properties inherent in the colorant. The colorant should more preferably be previously subjected to surface modification, for example, hydrophobic treatment using a material free from inhibition of polymerization.

The heat fixing method of the present invention will be detailed below.

The heat fixing method of the present invention comprises heat-fixing the toner image by a heat fixing means, to the light-transmitting recording material for electrophotography of the present invention, constituted as described above. A fixing assembly suited for applying the heat fixing method of the present invention will be described below.

Figure 2:
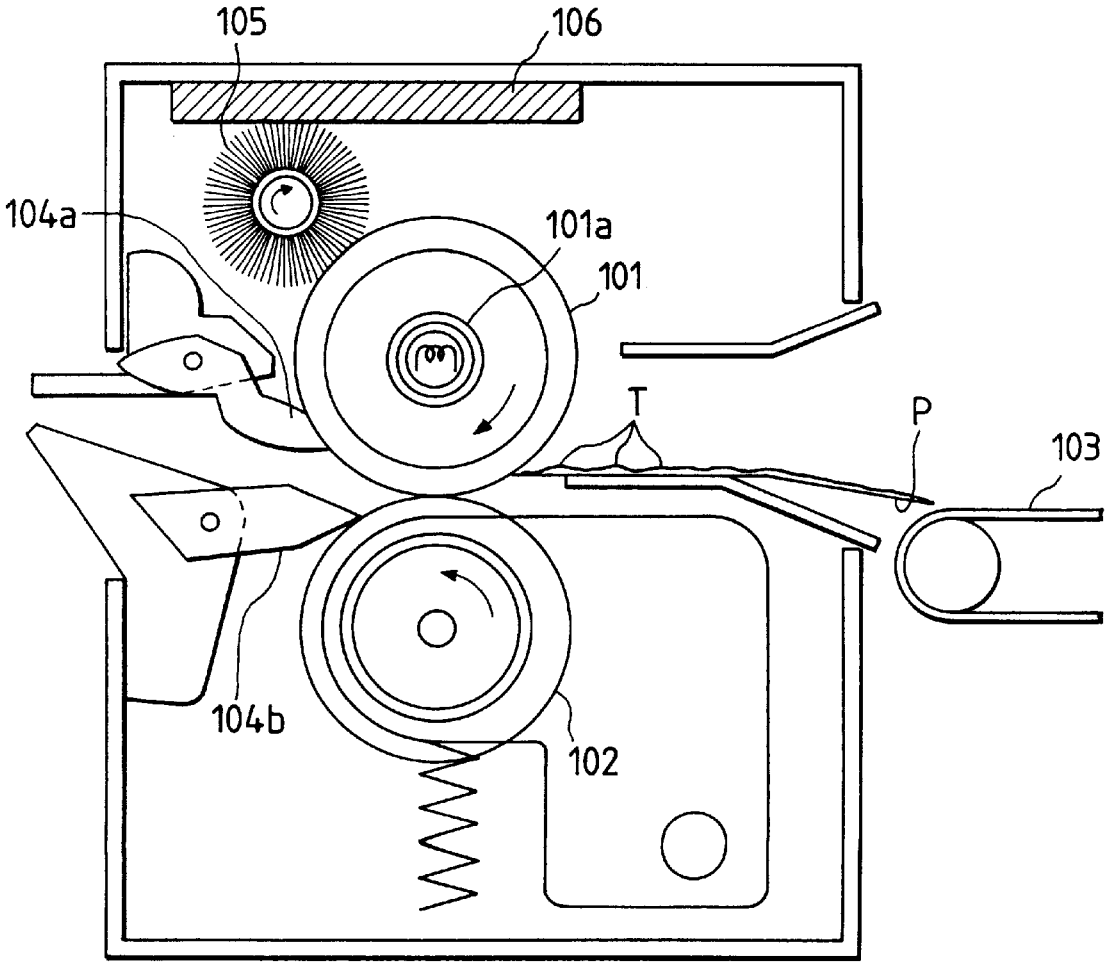
FIG. 2 illustrates a heat fixing means that can be used in the heat fixing method of the present invention.

FIG. 2 schematically illustrates an example of a heat roller type fixing assembly. The assembly of this example has, as shown in FIG. 2, a cylindrical heat roller 101 internally provided with a heating means such as a heater 1O1*a*. The heat roller 101 is clockwise rotated at the time of fixing.

Reference numeral 102 denotes a pressure roller as a pressure rotating member having a cylindrical shape, and is anti-clockwise rotated at the time of fixing while being brought into pressure contact with the heat roller 101. A recording material P as a material to be heated and to which unfixed toner T adheres as a toner image is transported by means of a transport belt 103 from the right side as viewed in the drawing, and pressed and heated by means of the heat roller 101 and the pressure roller 102, where the unfixed toner image T is fixed on the recording material P, which is then outputted to the left side.

Reference numerals 104*a* and 104*b* shown in FIG. 2 denote separating claws used to separate the recording material P so that it can be prevented from winding around the heat roller 101 or pressure roller 102 to cause faulty transport of the recording material. P. Reference numeral 106 denotes a felt-like oil pad impregnated with the release agent such as silicone oil having an appropriate viscosity. Reference numeral 105 denotes a cleaning roller around which brush-like fibers were implanted in a cylindrical form. The cleaning roller 105 is rotated to remove toner residues adhering to the periphery of the heat roller 101 and also appropriately feeds the release agent to the surface of the heat roller 101. The heat fixing means used in the present invention may be a heat fixing means to which the oil is additionally fed, as shown in FIG. 2, or may be a heat fixing means of an oil-less type that requires no additional feeding of oil. In the case of this oil-less type heat fixing means, the oil pad 106 is unnecessary.

A heating device of a film heating type is effective as having advantages stated below, compared with heating devices or toner image heat fixing assemblies of a heat roller type, a heating plate type, a belt heating type, a flash heating type and an open heating type, known as heating devices of different types.

(1) In the heating device of a film heating type, a low heat capacitance linear heater formed into a thin film having a low heat capacitance can be used as a heater element. Hence, electric power can be saved and wait time can be shortened (quick-start performance). In-machine temperature rise can also be controlled.

(2) In the heating device of a film heating type, the fixing point and the separating point can be separately set, and hence the offset can be effectively prevented. Besides, various disadvantages of the devices of different types can be overcome.

Figure 3:
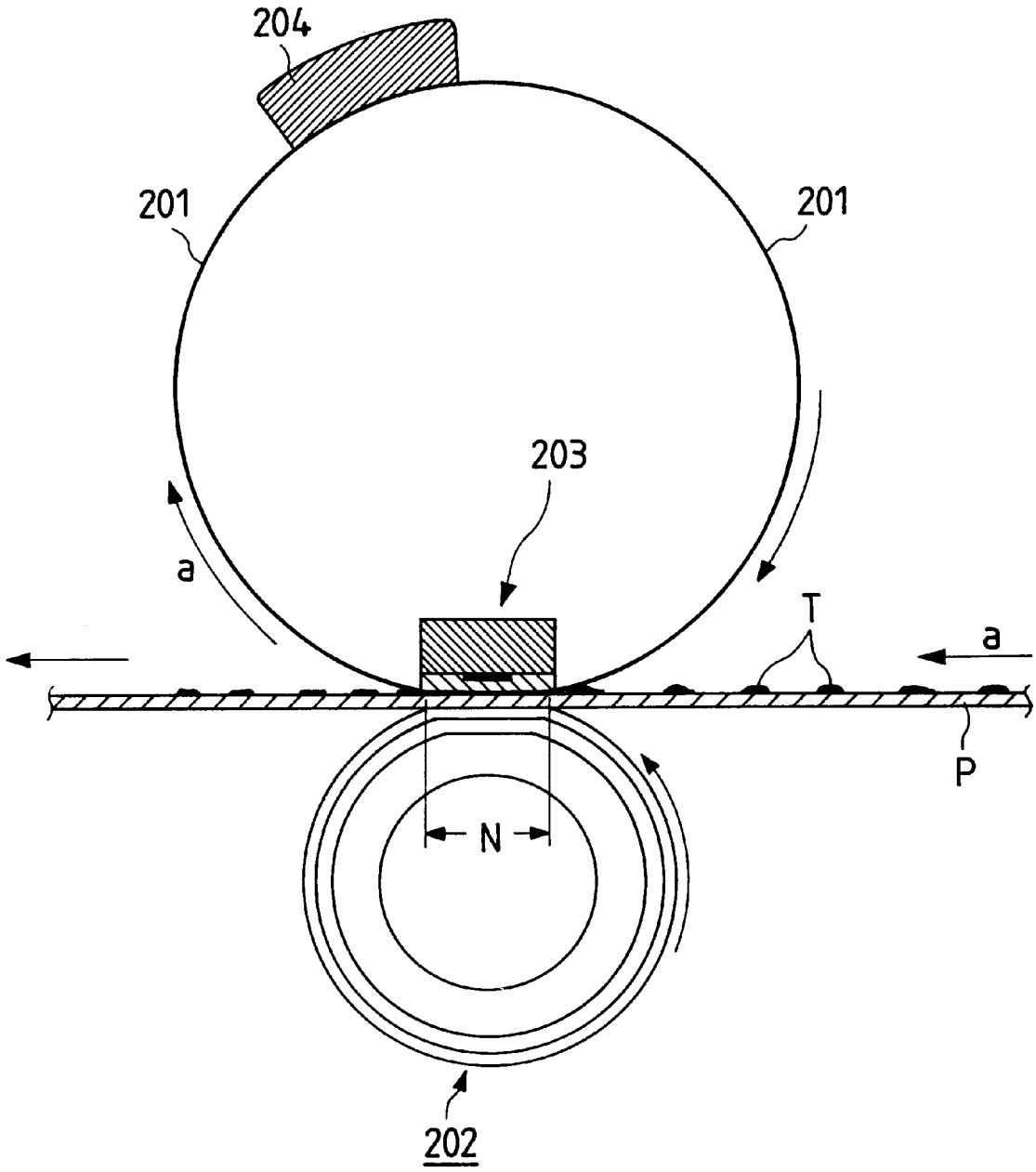
FIG. 3 illustrates another heat fixing means that can be used in the heat fixing method of the present invention.

FIG. 3 schematically illustrates a film heating type heat fixing means (a toner image heat fixing assembly) having the features as stated above.

In FIG. 3, reference numeral 203 denotes a heater element (a ceramic heater) stationarily held on a support. To this heater element 203, a heat-resistant film (a fixing film) 201 is slidably transported in close contact with it by the aid of a pressure roller 202 serving as a pressure rotating member. Then, a recording material P serving as a material to be heated and on which toner images are to be fixed is inserted between the heat-resistant film 201 and the pressure roller 202 at a pressure contact nip (a fixing nip) N formed by the heater element 203 and the pressure roller 202, holding the heat-resistant film 201 between them. The recording material is transported together with the heat-resistant film 201 while being interposingly held at the pressure contact nip N, whereby the heat of the heater element 203 is imparted to the surface of the recording material P through the heat-resistant film 201, so that unfixed visible images (toner images) on the recording material P are heat-fixed to the recording material P. The recording material P having been passed through the pressure contact nip N is separated from the surface of the heat-resistant film 201 and transported to the left side as viewed in the drawing. Reference numeral 204 denotes a felt-like pad impregnated with oil serving as a release agent, which is brought into touch with the heat-resistant film 201. In the assembly shown in FIG. 3, the oil is additionally fed to the heat-resistant film 201 through the pad 204. The heat fixing means used in the present invention may be a heat fixing means to which the oil is additionally fed, as shown in FIG. 3, or may be a heat fixing means of an oil-less type that requires no additional feeding of oil. In the case of this oil-less type heat fixing means, the oil pad 204 is not impregnated with oil.

In the present invention, in the toner image fixing assembly constituted as described above, it is preferable not to additionally feed the oil such as silicone oil, in view of the prevention of the recording material from its stickiness after fixing. However, so long as the oil is used in a quantity small enough not to make questionable the stickiness of the recording material after fixing, the heat fixing may be carried out while feeding oil to the fixing zone positioned between the heat fixing means and unfixed toner images present on the recording material. Stated specifically, in the heat fixing assembly shown in FIG. 2, the oil is fed through the oil pad denoted by reference numeral 106, and, in the heat fixing assembly shown in FIG. 3, through the pad denoted by reference numeral 204, each impregnated with oil such as silicone oil. As the quantity of the oil additionally fed to this fixing zone, the oil may be applied on the recording material so as to be in a quantity preferably not more than 0.04 mg/sheet (A4 size), and more preferably not more than 0.02 mg/sheet (A4 size).

According to the present invention, the recording material can be free from sticking to the surface of the heat fixing means at the time of fixing, in either case when the oil-less type heat fixing means making use of no oil is used or when the heat fixing means in which the oil is applied in a small quantity is utilized at the time of the fixing of toner images. Thus, when the images obtained are put in an overhead projector (OHP) and projected on a screen, color images or full-color images having a good color tone reproducibility can be obtained without grayish images projected even at halftone areas having especially a low image density.

EXAMPLES

The present invention will be described below in greater detail by giving Examples and Comparative Examples.

Example 1

On a transparent base material of 100 μm thick, formed of PET, a solution obtained by mixing 90 parts by weight of a water-based emulsion of polyester (number average molecular weight: 20,000; Tg: 40° C.) as a thermoplastic resin and 10 parts by weight of a water-based emulsion of microcrystalline wax (melting point: 90° C.) as a release agent under conditions making the polyester emulsion have a viscosity of 80 cps was coated as a coating solution by bar coating, followed by drying at 100° C. for 10 minutes to obtain a coating film of 15 μm in dried-coating thickness to form a surface layer. On the surface layer, a coating solution comprised of PQ-50B (a surface resistivity modifier available from Soken Chemical and Engineering Co., Ltd.) and isopropyl alcohol, having a solid matter concentration of about 2% was further coated, followed by drying to thereby control the surface resistivity to be about $1.2\times10^{10}$ Ω/square (20° C., 60% RH). Thus, light-transmitting OHP sheet 1, the light-transmitting recording material for electrophotography, was obtained.

The light-transmitting OHP sheet 1 thus obtained was examined on release properties by the methods shown below, to evaluate its releasability to the fixing roller from two aspects. Results obtained are shown in Table 1.

- Production of Cyan Toner A -

| | (by weight) |
|---|---|
| Styrene/butyl acrylate/divinylbenzene copolymer | 100 parts |
| Polyolefin wax (melting point: 100° C.) | 5 parts |
| C.I. Pigment Blue 15 | 4.5 parts |
| Di-tert-butylsalicylic acid metal compound | 3 parts |

The above materials were mixed, and then the mixture obtained was melt-kneaded using a twin-screw extruder. Thereafter, the kneaded product obtained was cooled and the cooled product was crushed, followed by pulverization using a gas-stream pulverizer. The pulverized product obtained was classified using an air classifier to obtain a blue powder toner with a weight average particle diameter of about 8.5 μm. To 100 parts by weight of this toner, 0.8 part by weight of negatively chargeable colloidal silica was externally added to obtain cyan toner A.

Evaluation of Release Properties

Evaluation of releasability-1 to fixing roller:

To 7 parts by weight of the cyan toner A obtained in the above, 93 parts by weight of a Cu-Zn-Fe ferrite carrier whose particle surfaces were coated with a styrene/methyl methacrylate copolymer was blended to produce a two-component type cyan developer 1. Using this two-component type cyan developer 1 and using a modified machine of a commercially available full-color copying machine (CLC-500, manufacture by CANON INC.) in an environment of temperature 23° C./humidity 65% RH, electrostatic images were formed, and developed at development contrast of 320 V to form toner images, which were then transferred to an A4-size light-transmitting OHP sheet 1 to form thereon unfixed cyan toner images having an image area percentage of 5%. The unfixed cyan toner images thus formed were fixed at a fixing temperature of 170° C. and a fixing speed of 30 mm/sec by means of an external fixing machine (having no function of oil application) constituted as shown in FIG. 2 and whose fixing roller surface was formed of a fluorine resin. During this fixing, releasability-1 of the OHP sheet to the fixing roller was evaluated according to the following evaluation criteria. Results obtained are shown in Table 1.

Evaluation criteria:

A (very good): The sheet was passed without sticking to the fixing roller.

B (good): The sheet slightly tended to stick to the fixing roller, only at its leading edge, but was passed without problem by the use of separating claws pressed against rollers at a pressure of about 10 gf.

C (poor): The sheet stuck to the fixing roller even by the use of separating claws pressed against rollers at a pressure of about 10 gf.

Evaluation of releasability-2 to fixing roller:

Using the external fixing machine (having no function of oil application) whose fixing roller surface was formed of a fluorine resin and under conditions of a fixing temperature of 170° C. and a fixing speed of 30 mm/sec, like in the case of the evalution of releasability-1, the light-transmitting OHP sheet 1 was passed through the fixing machine in the state that no cyan toner images were formed, to make evaluation according to the following evaluation criteria. Results obtained are shown in Table 1.

Evaluation criteria:

A (very good): The sheet was passed without sticking to the fixing roller.

B (good): The sheet slightly tended to stick to the fixing roller, only at its leading edge, but was passed without problem by the use of separating claws pressed against rollers at a pressure of about 10 gf.

C (poor): The sheet stuck to the fixing roller even by the use of separating claws pressed against rollers at a pressure of about 10 gf.

Example 2

Light-transmitting OHP sheet 2 was obtained in the same manner as in Example 1 except that the release agent emulsion was replaced with an emulsion of stearic acid amide (melting point: 100° C.). Its releasability was evaluated in the same manner as in Example 1 except that the light-transmitting OHP sheet 1 used therein was replaced with the light-transmitting OHP sheet 2 thus obtained.

Results obtained are shown in Table 1.

Example 3

Light-transmitting OHP sheet 3 was obtained in the same manner as in Example 1 except that the release agent emulsion was replaced with an emulsion of behenyl ketene dimer (melting point: 66° C.). Its releasability was evaluated in the same manner as in Example 1 except that the light-transmitting OHP sheet 1 used therein was replaced with the light-transmitting OHP sheet 3 thus obtained.

Results obtained are shown in Table 1.

Example 4

Light-transmitting OHP sheet 4 was obtained in the same manner as in Example 1 except that the release agent emulsion was replaced with an emulsion of polyethylene wax (melting point: 116° C.). Its releasability was evaluated in the same manner as in Example 1 except that the light-transmitting OHP sheet 1 used therein was replaced with the light-transmitting OHP sheet 4 thus obtained.

Results obtained are shown in Table 1.

Example 5

Light-transmitting OHP sheet 5 was obtained in the same manner as in Example 1 except that the thermoplastic resin emulsion was replaced with an emulsion of polyester (number average molecular weight: 16,500, Tg: 16° C.). Its releasability was evaluated in the same manner as in Example 1 except that the light-transmitting OHP sheet 1 used therein was replaced with the light-transmitting OHP sheet 5 thus obtained.

Results obtained are shown in Table 1.

Example 6

Light-transmitting OHP sheet 6 was obtained in the same manner as in Example 1 except that the thermoplastic resin emulsion was replaced with an emulsion of styrene/2-ethylhexyl acrylate (number average molecular weight: 300,000, Tg: 20° C.). Its releasability was evaluated in the same manner as in Example 1 except that the light-transmitting OHP sheet 1 used therein was replaced with the light-transmitting OHP sheet 6 thus obtained.

Results obtained are shown in Table 1.

Example 7

On a transparent base material of 100 $\mu$m thick, formed of PET, a mixture solution comprised of 20 parts by weight of polyester (number average molecular weight: 22,500; Tg: 43° C.) as a thermoplastic resin, 4 parts by weight of lanolin wax (melting point: 64° C.) as a release agent, 61 parts by weight of toluene and 15 parts by weight of MEK (methyl ethyl ketone) was coated as a coating solution by bar coating, followed by drying at 100° C. for 10 minutes to obtain a coating film of 15 $\mu$m in dried-coating thickness to form a surface layer. On the surface layer, a coating solution comprised of PQ-50B (a surface resistivity modifier available from Soken Chemical and Engineering Co., Ltd.) and isopropyl alcohol, having a solid matter concentration of about 2% was further coated, followed by drying to thereby control the surface resistivity to be about $1.2\times10^{10}$ Ω/square (20° C., 60% RH). Thus, light-transmitting OHP sheet 7 was obtained.

Its releasability was evaluated in the same manner as in Example 1 except that the light-transmitting OHP sheet 1 used therein was replaced with the light-transmitting OHP sheet 7 thus obtained.

Results obtained are shown in Table 1.

Example 8

Light-transmitting OHP sheet 8 was obtained in the same manner as in Example 7 except that the thermoplastic resin was replaced with another polyester (number average molecular weight: 22,500, Tg: 72° C.). Its releasability was evaluated in the same manner as in Example 1 except that the light-transmitting OHP sheet 1 used therein was replaced with the light-transmitting OHP sheet 8 thus obtained.

Results obtained are shown in Table 1.

Example 9

Light-transmitting OHP sheet 9 was obtained in the same manner as in Example 1 except that the thermoplastic resin was replaced with a urethane-modified polyester (number average molecular weight: 25,000, Tg: 73° C.). Its releasability was evaluated in the same manner as in Example 1 except that the light-transmitting OHP sheet 1 used therein was replaced with the light-transmitting OHP sheet 9 thus obtained.

Results obtained are shown in Table 1.

Comparative Example 1

Light-transmitting OHP sheet 10 was obtained in the same manner as in Example 1 except that the release agent emulsion was replaced with an emulsion of polyethylene wax (melting point: 124° C.). Its releasability was evaluated in the same manner as in Example 1 except that the light-transmitting OHP sheet 1 used therein was replaced with the light-transmitting OHP sheet 10 thus obtained.

Results obtained are shown in Table 1.

Comparative Example 2

Light-transmitting OHP sheet 11 was obtained in the same manner as in Example 7 except that the release agent emulsion was replaced with Guerbet alcohol (CONDEA VISTA Co., Ltd. ISOFOL 36, melting point: 36° C.). Its releasability was evaluated in the same manner as in Example 1 except that the light-transmitting OHP sheet 1 used therein was replaced with the light-transmitting OHP sheet 11 thus obtained.

Results obtained are shown in Table 1.

Comparative Example 3

Light-transmitting OHP sheet 12 was obtained in the same manner as in Example 1 except that the thermoplastic resin emulsion was replaced with an emulsion of an acrylate (number average molecular weight: 10,000, Tg: 20° C.) and the release agent emulsion was replaced with an emulsion of polyethylene wax (melting point: 124° C.). Its releasability was evaluated in the same manner as in Example 1 except that the light-transmitting OHP sheet 1 used therein was replaced with the light-transmitting OHP sheet 12 thus obtained.

Results obtained are shown in Table 1.

Comparative Example 4

Light-transmitting OHP sheet 13 was obtained in the same manner as in Example 1 except that the release agent emulsion was not used. Its releasability was evaluated in the same manner as in Example 1 except that the light-transmitting OHP sheet 1 used therein was replaced with the light-transmitting OHP sheet 13 thus obtained.

Results obtained are shown in Table 1.

TABLE 1

Evaluation Results on Releasability of Recording Materials of Examples 1–9 and Comparative Examples 1–4

| | Releasability | |
|---|---|---|
| Light-transmitting OHP sheet No. | 1 | 2 |
| Example: | | |
| 1 Light-transmitting OHP sheet 1 | A | A |
| 2 Light-transmitting OHP sheet 2 | A | A |
| 3 Light-transmitting OHP sheet 3 | A | A |
| 4 Light-transmitting OHP sheet 4 | A | A |
| 5 Light-transmitting OHP sheet 5 | B | B |
| 6 Light-transmitting OHP sheet 6 | A | A |
| 7 Light-transmitting OHP sheet 7 | A | A |
| 8 Light-transmitting OHP sheet 8 | A | B |
| 9 Light-transmitting OHP sheet 9 | A | B |
| Comparative Example: | | |
| 1 Light-transmitting OHP sheet 10 | C | C |
| 2 Light-transmitting OHP sheet 11 | C | C |
| 3 Light-transmitting OHP sheet 12 | C | C |
| 4 Light-transmitting OHP sheet 13 | C | C |

Example 10

On a transparent base material of 100 $\mu$m thick, formed of PET, a solution obtained by mixing 96 parts by weight of a water-based emulsion of polyester (number average molecular weight: 20,000; Tg: 23° C.) as a thermoplastic resin and 4 parts by weight a water-based emulsion of carnauba wax (melting point: 86° C., see FIG. 4) as a release agent under conditions making the polyester emulsion have a viscosity of 100 cps was coated as a coating solution by bar coating, followed by drying at 100° C. for 10 minutes to obtain a coating film of 8 $\mu$m in dried-coating thickness to form a surface layer. On the surface layer, a coating solution comprised of PQ-50B (a surface resistivity modifier available from Soken Chemical and Engineering Co., Ltd.) and isopropyl alcohol, having a solid matter concentration of about 2% was further coated, followed by drying to thereby control the surface resistivity to be about $1.5\times10^{10}$ Ω/square (20° C., 60% RH). Thus, light-transmitting OHP sheet 14, the light-transmitting recording material for electrophotography, was obtained.

Average dispersion diameter of the release agent present in the surface layer of the light-transmitting OHP sheet thus obtained was measured by the method shown below.

Results obtained are shown in Table 2.

Average dispersion diameter of release agent present in surface layer:

Cross sections of the surface layer of the light-transmitting OHP sheet 14 obtained were prepared by the $RuO_4$ dyed ultra-thin cut piece method, and were observed using a transmission electron microscope Model H-7100 FA (manufactured by Hitachi Ltd.) at an accelerating voltage of 100 kV. The major axis and minor axis of each dispersed particle of the release agent were measured at a maximum magnification that enabled recognition of at least 200 particles of the release agent dispersed particles, and the value of (major axis+minor axis)/2 was regarded as dispersion diameter of each particle. An average value of the diameters of these 200 dispersed particles was used as the average dispersion diameter.

Transparency-1 of the light-transmitting OHP sheet 14 obtained was also measured by the method shown below.

Results obtained are shown in Table 2.

Transparency-1:

To examine the transparency of the light-transmitting recording material for electrophotography, the total light ray transmittance and haze as the OHP sheet were measured according to JIS K-7105, using MODEL 1001DP (manufactured by Nippon Denshoku Kogyo K. K.).

Evaluation criteria:

A (very good): An instance where the total light ray transmittance is 87% or more and the haze is 3% or less.

B (good): The total light ray transmittance is 84% or more and the haze is less than 10%.

C (average): The total light ray transmittance is 80% or more and the haze is less than 10%.

D (poor): The total light ray transmittance is less than 80% and the haze is 10% or more.

Using the light-transmitting OHP sheet 14 obtained, its releasability was also evaluated in the same manner as in Example 1. Results obtained are shown in Table 2.

Example 11

Light-transmitting OHP sheet 15 was obtained in the same manner as in Example 10 except that the thermoplastic resin emulsion was replaced with an emulsion of polyester (number average molecular weight: 10,000, Tg: 62° C.).

Using the light-transmitting OHP sheet 15 thus obtained, the average dispersion diameter of the release agent present in the surface layer was measured and also the transmittance and releasability of the sheet were evaluated in the same manner as in Example 10. The results of measurement and evaluation are shown in Table 2.

Example 12

Light-transmitting OHP sheet 16 was obtained in the same manner as in Example 10 except that the thermoplastic resin emulsion was replaced with an emulsion of another polyester (number average molecular weight: 20,000, Tg: −10° C.).

Using the light-transmitting OHP sheet 16 thus obtained, the average dispersion diameter of the release agent present in the surface layer was measured and also the transmittance and releasability of the sheet were evaluated in the same manner as in Example 10. The results of measurement and evaluation are shown in Table 2.

Example 13

Light-transmitting OHP sheet 17 was obtained in the same manner as in Example 10 except that the thermoplastic resin emulsion was replaced with an emulsion of another polyester (number average molecular weight: 20,000, Tg: −20° C.).

Using the light-transmitting OHP sheet 17 thus obtained, the average dispersion diameter of the release agent present in the surface layer was measured and also the transmittance and releasability of the sheet were evaluated in the same manner as in Example 10. The results of measurement and evaluation are shown in Table 2.

Example 14

Light-transmitting OHP sheet 18 was obtained in the same manner as in Example 10 except that the release agent emulsion was replaced with an emulsion of polyethylene wax (melting point: 116° C.).

Using the light-transmitting OHP sheet 18 thus obtained, the average dispersion diameter of the release agent present in the surface layer was measured and also the transmittance and releasability of the sheet were evaluated in the same manner as in Example 10. The results of measurement and evaluation are shown in Table 2.

Example 15

Light-transmitting OHP sheet 19 was obtained in the same manner as in Example 10 except that the release agent emulsion was replaced with an emulsion of stearic acid amide (melting point: 100° C.).

Using the light-transmitting OHP sheet 19 thus obtained, the average dispersion diameter of the release agent present in the surface layer was measured and also the transmittance and releasability of the sheet were evaluated in the same manner as in Example 10. The results of measurement and evaluation are shown in Table 2.

Example 16

Light-transmitting OHP sheet 20 was obtained in the same manner as in Example 10 except that the thermoplastic resin emulsion was replaced with an emulsion of styrene/2-ethylhexyl acrylate (number average molecular weight: 50,000, Tg: 33° C.).

Using the light-transmitting OHP sheet 20 thus obtained, the average dispersion diameter of the release agent present in the surface layer was measured and also the transmittance and releasability of the sheet were evaluated in the same manner as in Example 10. The results of measurement and evaluation are shown in Table 2.

Example 17

On a transparent base material of 100 $\mu$m thick, formed of PET, a mixture solution comprised of 20 parts by weight of polyester (number average molecular weight: 15,500; Tg: 47° C.) as a thermoplastic resin, 1 part by weight of lanolin wax (melting point: 64° C.) as a release agent, 64 parts by weight of toluene and 15 parts by weight of MEK was coated as a coating solution by bar coating, followed by drying at 100° C. for 10 minutes to obtain a coating film of 10 $\mu$m in dried-coating thickness to form a surface layer. On the surface of the surface layer, a coating solution comprised of PQ-50B (a surface resistivity modifier available from Soken Chemical and Engineering Co., Ltd.) and isopropyl alcohol, having a solid matter concentration of about 2% was further coated, followed by drying to thereby control the surface resistivity to be about $1.2\times10^{10}$ Ω/square (20° C., 60% RH). Thus, light-transmitting OHP sheet 21 was obtained.

Using the light-transmitting OHP sheet 21 thus obtained, the average dispersion diameter of the release agent present in the surface layer was measured and also the transmittance and releasability of the sheet were evaluated in the same manner as in Example 10. The results of measurement and evaluation are shown in Table 2.

Example 18

Light-transmitting OHP sheet 22 was obtained in the same manner as in Example 17 except that the thermoplastic resin was replaced with another polyester (number average molecular weight: 22,500, Tg: 72° C.).

Using the light-transmitting OHP sheet 22 thus obtained, the average dispersion diameter of the release agent present in the surface layer was measured and also the transmittance and releasability of the sheet were evaluated in the same manner as in Example 10. The results of measurement and evaluation are shown in Table 2.

Example 19

On a transparent base material of 100 μm thick, formed of PET, a coating solution comprised of 20 parts by weight of polyester (number average molecular weight: 17,500; Tg: 67° C.) as a thermoplastic resin, 1 part by weight of lanolin wax (melting point: 64° C.) as a release agent, 5 parts by weight of PQ-50B as a surface resistivity modifier, 37 parts by weight of toluene and 37 parts by weight of MEK was coated, followed by drying to form a surface layer. Thus, light-transmitting OHP sheet 23 was obtained, having a surface resistivity of about $2.3\times10^{11}$ Ω/square (20° C., 60% RH).

Using the light-transmitting OHP sheet 23 thus obtained, the average dispersion diameter of the release agent present in the surface layer was measured and also the transmittance and releasability of the sheet were evaluated in the same manner as in Example 10. The results of measurement and evaluation are shown in Table 2.

Comparative Example 20

Light-transmitting OHP sheet 24 was obtained in the same manner as in Example 17 except that the thermoplastic resin was replaced with another polyester (number average molecular weight: 15,000, Tg: 67° C.).

Using the light-transmitting OHP sheet 24 thus obtained, the average dispersion diameter of the release agent present in the surface layer was measured and also the transmittance and releasability of the sheet were evaluated in the same manner as in Example 10. The results of measurement and evaluation are shown in Table 2.

Comparative Example 21

Light-transmitting OHP sheet 25 was obtained in the same manner as in Example 17 except that the thermoplastic resin was replaced with a urethane-modified polyester (number average molecular weight: 30,000, Tg: 23° C.).

Using the light-transmitting OHP sheet 25 thus obtained, the average dispersion diameter of the release agent present in the surface layer was measured and also the transmittance and releasability of the sheet were evaluated in the same manner as in Example 10. The results of measurement and evaluation are shown in Table 2.

Comparative Example 22

Light-transmitting OHP sheet 26 was obtained in the same manner as in Example 16 except that the coating solution was prepared under conditions making the styrene/2-ethylhexyl acrylate emulsion have a viscosity of 300 cps.

Using the light-transmitting OHP sheet 26 thus obtained, the average dispersion diameter of the release agent present in the surface layer was measured and also the transmittance and releasability of the sheet were evaluated in the same manner as in Example 10. The results of measurement and evaluation are shown in Table 2.

Comparative Example 5

Light-transmitting OHP sheet 27 was obtained in the same manner as in Example 10 except that the release agent emulsion was replaced with an emulsion of stearic acid ethylenebisamide (melting point: 141° C.).

Using the light-transmitting OHP sheet 27 thus obtained, the average dispersion diameter of the release agent present in the surface layer was measured and also the transmittance and releasability of the sheet were evaluated in the same manner as in Example 10. The results of measurement and evaluation are shown in Table 2.

Comparative Example 6

Light-transmitting OHP sheet 28 was obtained in the same manner as in Example 17 except that the release agent emulsion was replaced with Guerbet alcohol (melting point: 36° C.).

Using the light-transmitting OHP sheet 28 thus obtained, the average dispersion diameter of the release agent present in the surface layer was measured and also the transmittance and releasability of the sheet were evaluated in the same manner as in Example 10. The results of measurement and evaluation are shown in Table 2.

Comparative Example 7

Light-transmitting OHP sheet 29 was obtained in the same manner as in Example 10 except that the release agent emulsion was not used.

Using the light-transmitting OHP sheet 29 thus obtained, the average dispersion diameter of the release agent present in the surface layer was measured and also the transmittance and releasability of the sheet were evaluated in the same manner as in Example 10. The results of measurement and evaluation are shown in Table 2.

Example 23

Using a fixing assembly having the same external fixing machine and the same roller constitution as those used in the evaluation in Example 1, the light-transmitting OHP sheet 14, obtained in Example 10, was passed through it under conditions of a fixing temperature of 170° C. and a fixing speed of 30 mm/sec while additionally applying oil in an amount of 0.04 mg/sheet (A4 size) by means of an oil applicator, to make evaluation according to the same method and evaluation criteria as in Example 1. The results of evaluation are shown in Table 2.

TABLE 2

| Light-transmitting OHP sheet No. | Average dispersion diameter (μm) | Trans-parency-1 | Releasability 1 | Releasability 2 |
|---|---|---|---|---|
| Example: | | | | |
| 10 OHP sheet 14 | 0.10 | A | A | A |
| 11 OHP sheet 15 | 0.30 | B | A | A |
| 12 OHP sheet 16 | 0.08 | A | A | A |
| 13 OHP sheet 17 | 0.12 | A | B | B |
| 14 OHP sheet 18 | 0.50 | B | A | B |
| 15 OHP sheet 19 | 0.23 | B | A | A |
| 16 OHP sheet 20 | 0.48 | B | B | B |
| 17 OHP sheet 21 | 0.22 | A | A | A |
| 18 OHP sheet 22 | 0.70 | B | A | A |
| 19 OHP sheet 23 | 0.81 | B | A | B |
| 20 OHP sheet 24 | 1.2 | C | A | A |
| 21 OHP sheet 25 | 1.5 | C | A | A |
| 22 OHP sheet 26 | 1.8 | C | B | B |
| 23 OHP sheet 14 *(oil applied) | 0.10 | A | A | A |
| Comparative Example: | | | | |
| 5 OHP sheet 27 | 6.1 | D | C | C |
| 6 OHP sheet 28 | 1.3 | D | C | C |
| 7 OHP sheet 29 | —*1 | B | C | C |

*1: No release agent is used.

Example 24

Production of Cyan Toner B

In 709 parts by weight of ion-exchanged water, 451 parts by weight of an aqueous 0.1M $Na_3PO_4$ solution was introduced, followed by heating to 60° C. and then stirring at 12,000 rpm using a TK-type homomixer (manufactured by Tokushu Kika Kogyo Co., Ltd.). To the resulting mixture, 67.7 parts by weight of an aqueous 1.0M $CaCl_2$ solution was added little by little to obtain a dispersion medium containing $Ca_3(PO_4)_2$.

| | (by weight) |
|---|---|
| Styrene | 170 parts |
| 2-Ethylhexyl acrylate | 30 parts |
| Paraffin wax (m.p.: 75° C.) | 50 parts |
| C.I. Pigment Blue 15 | 10 parts |
| Styrene/methacrylic acid/methyl methacrylate copolymer | 5 parts |
| Di-tert-butylsalicylic acid metal compound | 3 parts |

Of the above materials, only C.I. Pigment Blue 15, di-tert-butylsalicylic acid metal compound and styrene were premixed using Ebara Milder (manufactured by Ebara Corporation). Next, all the above materials were heated to 60° C., followed by dissolution and dispersion to obtain a monomer mixture. While the monomer mixture obtained was maintained at 60° C., 10 parts by weight of a polymerization initiator dimethyl 2,2'-azobisisobutylate was added and dissolved. Thus a polymerizable monomer composition was prepared.

The above monomer composition was introduced in the dispersion medium prepared in a 2 liter flask of the TK homomixer. Using the TK homomixer, made to have an atmosphere of nitrogen, stirring was carried out at 60° C. and at 10,000 rpm for 20 minutes to granulate the monomer composition. Thereafter, while stirring with a paddle agitating blade, the reaction was carried out at 60° C. for 3 hours, and then at 80° C. for further 10 hours to complete polymerization.

After the polymerization was completed, the reaction product was cooled, and hydrochloric acid was added thereto to dissolve the $Ca_3(PO_4)2$, followed by filtration and washing with water and then drying to obtain cyan toner particles.

Particle diameters of the cyan toner particles thus obtained were measured with a Coulter counter to reveal that the toner particles had a weight average particle diameter of 8.2 $\mu$m and also had a sharp particle size distribution. To 100 parts by weight of the cyan toner particles obtained, 0.7 part by weight of hydrophobic silica having a specific surface area of 200 $m^2/g$ as measured by the BET method was externally added to obtain cyan toner B.

Production of Magenta Toner, Toner C

The procedure for the production of the cyan toner B was repeated to obtain magenta toner C, except that the C.I. Pigment Blue 15 used in the production of the cyan toner B was replaced with 9 parts by weight of C.I. Pigment Red 122.

Production of Yellow Toner, Toner D

The procedure for the production of the cyan toner B was repeated to obtain yellow toner D, except that the C.I. Pigment Blue 15 used in the production of the cyan toner B was replaced with 8 parts by weight of C.I. Pigment Yellow 17.

Production of Black Toner, Toner E

The procedure for the production of the cyan toner B was repeated to obtain black toner E, except that the C.I. Pigment Blue 15 used in the production of the cyan toner B was replaced with 12 parts by weight of commercially available carbon black.

To 7 parts by weight each of the cyan toner B, magenta toner C, yellow toner D and black toner E thus obtained, 93 parts by weight of a Cu-Zn-Fe ferrite carrier having been surface-coated with a styrene/methyl methacrylate copolymer were blended. Thus, two-component type cyan developer 2, two-component type magenta developer 3, two-component type yellow developer 4 and two-component type black developer 5 were respectively prepared.

Using these four-color developers and using a modified machine of a commercially available full-color copying machine (CLC-500, manufacture by CANON INC.) in an environment of temperature 23° C./humidity 65% RH, electrostatic images were formed, and developed at development contrast of 320 V to form toner images, which were then transferred to the A4-size light-transmitting OHP sheet 14 as used is Example 10 to form thereon unfixed full-color toner images having an image area percentage of 5%. The unfixed full-color toner images thus formed were fixed at a fixing temperature of 170° C. and a fixing speed of 30 mm/sec by means of an external fixing machine (having no function of oil application) constituted as shown in FIG. 2 and whose fixing roller surface was formed of a fluorine resin.

As a result, the toner images were well fixed to the light-transmitting OHP sheet 14 without its sticking to the fixing roller. Then, the sheet on which the resulting full-color images were formed was set in an OHP to project the images. As a result, sharp full-color projected images were obtained without grayish images at the halftone image density areas and highlight image density areas.

Example 25

On a transparent base material of 100 $\mu$m thick, formed of PET, a mixture solution comprised of 320 parts by weight of a water-based emulsion of polyester (number average molecular weight: 20,000; Tg: 40° C.; solid matter: 30%; softening point: 160° C.) as a thermoplastic resin and 9 parts by weight of a water-based emulsion of carnauba wax (melting point: 86° C.; solid matter: 45%) as a release agent was coated as a coating solution by bar coating, followed by drying at 100° C. for 10 minutes to obtain a coating film of 12 $\mu$m in dried-coating thickness to form a surface layer. On the surface layer, a coating solution comprised of PQ-50B (a surface resistivity modifier available from Soken Chemical and Engineering Co., Ltd.) and isopropyl alcohol, having a solid matter concentration of about 2% was further coated, followed by drying to thereby control the surface resistivity to be about $10^{11}$ Ω/square (20° C., 60% RH). Thus, light-transmitting OHP sheet 30 was obtained.

The light-transmitting OHP sheet 30 thus obtained was examined by the method shown below to evaluate i) image characteristics of the images obtained by heat-fixing toner images, ii) releasability-3 of the light-transmitting OHP sheet 30 to the fixing roller when the toner images were fixed and iii) transparency-2 of the same, by the method also shown below. Results obtained are shown in Table 4.

The light-transmitting OHP sheet of the present Example was released from the fixing assembly without sticking to the fixing roller, and good transparent images were obtained. The sheet on which the resulting full-color images were formed was set in an OHP to project the images. As a result, beautiful projected images were obtained without damage of transparency and without grayish images at the halftone image density areas and highlight image density areas.

| - Production of Yellow Toner, Toner F - | |
|---|---|
| | (by weight) |
| Styrene/butyl acrylate/divinylbenzene copolymer | 100 parts |
| Polyolefin wax (melting point: 100° C.) | 5 parts |
| C.I. Pigment Yellow 17 | 4.5 parts |
| Di-tert-butylsalicylic acid metal compound | 3 parts |

The above materials were mixed, and then the mixture obtained was melt-kneaded using a twin-screw extruder. Thereafter, the kneaded product obtained was cooled and the cooled product was crushed, followed by pulverization using a gas-stream pulverizer. The pulverized product obtained was classified using an air classifier to obtain a yellow powder toner with a weight average particle diameter of about 8.5 $\mu$m. To 100 parts by weight of this toner, 0.8 part by weight of negatively chargeable colloidal silica was externally added to obtain yellow toner F.

Image Reproduction

Using the yellow toner F thus obtained and using a modified machine of a commercially available full-color copying machine (CLC-500, manufacture by CANON INC.) in an environment of temperature 23° C./humidity 65% RH, electrostatic images were formed, and developed at development contrast of 320 V to form toner images, which were then transferred to the A4-size light-transmitting OHP sheet 30 to form thereon unfixed yellow toner images. The unfixed yellow toner images were fixed at a fixing temperature of 170° C. and a fixing speed of 30 mm/sec by means of an external fixing machine (having no function of oil application) constituted as shown in FIG. 2 and whose fixing roller surface was formed of a fluorine resin.

Evaluation of Image Characteristics

The light-transmitting OHP sheet 30 having the resulting yellow color images thus formed was set in an OHP, and yellow color images were projected on a screen. Color tone reproducibility at halftone image density areas and highlight image density areas was evaluated by visual organoleptic evalution according to the following evaluation criteria. Results obtained are shown in Table 4.

Here, the halftone image density areas and the highlight image density areas are meant to be areas where the yellow color images obtained have a yellow density within the range of 0.2 to 1.5 as measured by a Macbeth reflection densitometer RD-1255.

Evaluation criteria:

A (very good): The halftone image density areas and highlight image density areas are not grayish and have a good color tone reproducibility.

B (good): The halftone image density areas and highlight image density areas are a little grayish and have a somewhat orange color tone.

C (poor): The halftone image density areas and highlight image density areas are grayish.

Evaluation of Releasability-3

To 7 parts by weight of the yellow toner F, 93 parts by weight of a Cu-Zn-Fe ferrite carrier having been surface-coated with a styrene/methyl methacrylate copolymer were blended to obtain two-component type yellow developer 6. Using this two-component type yellow developer 6 and using a modified machine of a commercially available full-color copying machine (CLC-500, manufacture by CANON INC.) in an environment of temperature 23° C./humidity 65% RH, electrostatic images were formed, and developed at development contrast of 320 V to form toner images, which were then transferred to the A4-size light-transmitting OHP sheet 30 to form thereon unfixed yellow toner images having an image area percentage of 5%. The unfixed yellow toner images thus formed were fixed at a fixing temperature of 170° C. and a fixing speed of 30 mm/sec by means of an external fixing machine (having no function of oil application) constituted as shown in FIG. 2 and whose fixing roller surface was formed of a fluorine resin. Releasability-3 to the fixing roller during this fixing was evaluated by the following method and according to the following evaluation criteria. Results obtained are shown in Table 4.

Evaluation criteria:

A (very good): The sheet was passed without sticking to the fixing roller.

B (good): The sheet slightly tended to stick to the fixing roller, only at its leading edge, but was passed without problem by the use of separating claws pressed against rollers at a pressure of about 10 gf.

C (poor): The sheet stuck to the fixing roller even by the use of separating claws pressed against rollers at a pressure of about 10 gf.

Evaluation of Transparency-2

To examine the transparency of the light-transmitting OHP sheet 30, the total light ray transmittance and haze were measured according to JIS K-7105, using MODEL 1001DP (manufactured by Nippon Denshoku Kogyo K. K.), and evaluated according to the following evaluation criteria. Results obtained are shown in Table 4.

Evaluation criteria:

A (very good): The total light ray transmittance is 84% or more.

B (good): The total light ray transmittance is 80% or more to less than 84%.

C (poor): The total light ray transmittance is less than 80%.

Examples 26 to 32

Light-transmitting OHP sheets 31 to 37 were respectively obtained in the same manner as in Example 25 except that the coating solution used therein was replaced with those composed as shown in FIG. 3.

The image characteristics, releasability-3 and transparency-2 were evaluated in the same manner as in Example 25 except that the light-transmitting OHP sheets 31 to 37 thus obtained were used.

The results of evaluation are shown in Table 4.

Comparative Example 8

Light-transmitting OHP sheet 38 was obtained in the same manner as in Example 25 except that the coating solution used therein was replaced with one composed as shown in FIG. 3.

The image characteristics, releasability-3 and transparency-2 were evaluated in the same manner as in Example 25 except that the light-transmitting OHP sheet 38 thus obtained were used.

The results of evaluation are shown in Table 4.

TABLE 3

| | Light-transmitting OHP sheet No. | Thermoplastic resin: Component (Solid matter, %) (Softening point, ° C.) | | Number av. molecular weight (Mn) | Tg (° C.) | Content (pbw) | Release agent: Component (Solid matter, %) | | m.p. (° C.) | Content (pbw) | m.p./Tg dif.* (° C.) |
|---|---|---|---|---|---|---|---|---|---|---|---|
| Example: | | | | | | | | | | | |
| 25 | OHP sheet 30 | Polyester resin emulsion | (30%) (160° C.) | 20,000 | 40 | 320 | Carnauba wax emulsion | (45%) | 86 | 25 | 46 |
| 26 | OHP sheet 31 | Polyester resin emulsion | (15%) (130° C.) | 20,000 | 23 | 350 | Carnauba wax emulsion | (45%) | 86 | 17 | 63 |
| 27 | OHP sheet 32 | Polyester resin emulsion | (34%) (170° C.) | 15,000 | 67 | 250 | Microcrystalline wax emulsion | (30%) | 90 | 30 | 23 |
| 28 | OHP sheet 33 | Polyester resin emulsion | (30%) (125° C.) | 20,000 | 7 | 300 | Microcrystalline wax emulsion | (30%) | 90 | 40 | 83 |
| 29 | OHP sheet 34 | Styrene-2-ethylhexyl acrylate emulsion | (25%) | 50,000 | 33 | 280 | Paraffin wax emulsion | (30%) | 105 | 23 | 72 |
| 30 | OHP sheet 35 | Polyester resin emulsion | (30%) (165° C.) | 20,000 | 61 | 300 | Paraffin wax emulsion | (30%) | 75 | 23 | 14 |
| 31 | OHP sheet 36 | Polyester resin emulsion | (34%) (170° C.) | 15,000 | 67 | 300 | Paraffin wax emulsion | (30%) | 63 | 33 | −4 |
| 32 | OHP sheet 37 | Polyester resin emulsion | (34%) (170° C.) | 15,000 | 67 | 250 | Paraffin wax emulsion | (30%) | 75 | 23 | 8 |
| Comparative Example: | | | | | | | | | | | |
| 8 | OHP sheet 38 | Polyester resin emulsion | (30%) (160° C.) | 20,000 | 40 | 320 | Not used | | — | — | — |

*Difference between melting point and Tg.

TABLE 4

| Light-transmitting OHP sheet No. | Image characteristics | Releasability-3 | Transparency-2 |
|---|---|---|---|
| Example: | | | |
| 25 OHP sheet 30 | A | A | A |
| 26 OHP sheet 31 | A | A | A |
| 27 OHP sheet 32 | A | A | A |
| 28 OHP sheet 33 | A | A | A |
| 29 OHP sheet 34 | A | B | A |
| 30 OHP sheet 35 | A | B | B |
| 31 OHP sheet 36 | B | B | B |
| 32 OHP sheet 37 | B | B | B |
| Comparative Example: | | | |
| 8 OHP sheet 38 | —*2 | C | A |

*2: Image characteristics can not be evaluated because the sheet sticks to the fixing roller.

Example 33

Using the same four color, two-component type developers as those used in Example 24, i.e., the two-component type cyan developer 2, two-component type magenta developer 3, two-component type yellow developer 4 and two-component type black developer 5, and using a modified machine of a commercially available full-color copying machine (CLC-500, manufacture by CANON INC.) in an environment of temperature 23° C./humidity 65% RH, electrostatic images were formed, and developed at development contrast of 320 V to form toner images, which were then transferred to the A4-size light-transmitting OHP sheet 30 as used in Example 25, to form thereon unfixed full-color toner images. The unfixed full-color toner images thus formed were fixed to the light-transmitting OHP sheet 30 using an external fixing machine constituted as shown in FIG. 2 and whose fixing roller surface was formed of a fluorine resin, under conditions of a fixing temperature of 170° C. and a fixing speed of 30 mm/sec while additionally applying oil in an amount of 0.04 mg/sheet (A4 size) by means of an oil applicator.

As a result, the toner images were well fixed to the light-transmitting OHP sheet 30 without its sticking to the fixing roller, and good transparent images free of stickiness due to adhesion of oil were obtained. The sheet on which the resulting full-color images were formed was set in an OHP to project the images. As a result, beautiful projected images were obtained without damage of transparency and without grayish images at the halftone image density areas and highlight image density areas.

Example 34

Unfixed full-color toner images were fixed to the light-transmitting OHP sheet 30 in the same manner as in Example 33 except that the external fixing machine used therein was replaced with a film heat fixing assembly (having no function of oil application) constituted as shown in FIG. 3 and the toner images were fixed at a fixing temperature of 170° C. and a fixing speed of 30 mm/sec. As a result, like Example 33, the toner images were well fixed to the light-transmitting OHP sheet 30 without its sticking to the fixing roller. The sheet on which the resulting full-color images were formed was set in an OHP to project the images. As a result, beautiful projected images were obtained without damage of transparency and without grayish images at the halftone image density areas and highlight image density areas.

What is claimed is:

1. A light-transmitting recording material for electrophotography, comprising a base material and a surface layer formed on the base material, wherein:

said surface layer contains a thermoplastic resin and a release agent, the release agent having a melting point of from 40° C. to 120° C., wherein said release agent is present in said surface layer in a dispersed state with an average dispersion diameter at least 0.01 μm and less than 1.00 μm, and wherein said light-transmitting recording material has a total light ray transmittance of at least 80% and a haze of no more than 10.

2. The recording material according to claim 1, wherein said thermoplastic resin has a number average molecular weight of from 3,000 to 500,000.

3. The recording material according to claim 1, wherein said thermoplastic resin has a glass transition temperature of from −10° C. to 80° C.

4. The recording material according to claim 1, wherein said release agent has a melting point of from 50° C. to 120° C.

5. The recording material according to claim 1, wherein said release agent comprises at least one wax selected from the group consisting of a vegetable wax and a derivative thereof, a mineral wax and a derivative thereof, an animal wax and a derivative thereof, a petroleum wax and a derivative thereof, and a synthetic wax and a derivative thereof.

6. The recording material according to claim 1, wherein said release agent is present in said surface layer in a dispersed state with an average dispersion diameter of from 0.04 μm to 0.50 μm.

7. The recording material according to claim 1, wherein said release agent is contained in said surface layer in an amount of from 0.01% by weight to 30% by weight based on the weight of the surface layer.

8. The recording material according to claim 1, wherein said release agent is contained in said surface layer in an amount of from 0.1% by weight to 30% by weight based on the weight of the surface layer.

9. The recording material according to claim 1, wherein the melting point of said release agent is higher than the glass transition temperature Tg of said thermoplastic resin by at least 10° C.

10. The recording material according to claim 1, wherein the melting point of said release agent is higher than the glass transition temperature Tg of said thermoplastic resin by at least 20° C.

11. The recording material according to claim 1, wherein the melting point of said release agent is higher than the glass transition temperature Tg of said thermoplastic resin by 10° C. to 120° C.

12. The recording material according to claim 1, wherein said light-transmitting recording material has a total light ray transmittance of at least 85% and a haze of no more than 7.

13. The recording material according to claim 1, wherein a layer containing an antistatic agent is formed on said surface layer.

14. The recording material according to claim 1, wherein said surface layer further contains an antistatic agent.

15. A heat fixing method comprising forming a toner image on a light-transmitting recording material by the use of a toner, and heat-fixing the toner image to the light-transmitting recording material, wherein:

said light-transmitting recording material comprises a base material and a surface layer formed on the base material;

said surface layer containing a thermoplastic resin and a release agent, the release agent having a melting point of from 40° C. to 12° C.;

said release agent is present in said surface layer in a dispersed state with an average dispersion diameter at least 0.01μm and less than 1.00 μm; and said light-transmitting recording material has a total light ray transmittance of at least 80% and a haze of no more than 10.

16. The heat fixing method according to claim 15, wherein said thermoplastic resin has a number average molecular weight of from 3,000 to 500,000.

17. The heat fixing method according to claim 15, wherein said thermoplastic resin has a glass transition temperature of from −10° C. to 80° C.

18. The heat fixing method according to claim 15, wherein said release agent has a melting point of from 50° C. to 120° C.

19. The heat fixing method according to claim 15, wherein said release agent comprises at least one wax selected from the group consisting of a vegetable wax and a derivative thereof, a mineral wax and a derivative thereof, an animal wax and a derivative thereof, a petroleum wax and a derivative thereof, and a synthetic wax and a derivative thereof.

20. The heat fixing method according to claim 15, wherein said release agent is present in said surface layer in a dispersed state with an average dispersion diameter of from 0.04 μm to 0.50 μm.

21. The heat fixing method according to claim 15, wherein said release agent is contained in said surface layer in an amount of from 0.01% by weight to 30% by weight based on the weight of the surface layer.

22. The heat fixing method according to claim 15, wherein said release agent is contained in said surface layer in an amount of from 0.1% by weight to 30% by weight based on the weight of the surface layer.

23. The heat fixing method according to claim 15, wherein the melting point of said release agent is higher than the glass transition temperature Tg of said thermoplastic resin by at least 10° C.

24. The heat fixing method according to claim 15, wherein the melting point of said release agent is higher than the glass transition temperature Tg of said thermoplastic resin by at least 20° C.

25. The heat fixing method according to claim 15, wherein the melting point of said release agent is higher than the glass transition temperature Tg of said thermoplastic resin by 10° C. to 120° C.

26. The heat fixing method according to claim 15, wherein said light-transmitting recording material has a total light ray transmittance of at least 85% and a haze of no more than 7.

27. The heat fixing method according to claim 15, wherein a layer containing an antistatic agent is formed on said surface layer.

28. The heat fixing method according to claim 15, wherein said surface layer further contains an antistatic agent.

29. The heat fixing method according to claim 15, wherein said toner contains at least a binder resin, a wax component and a colorant; said wax component being contained in said toner in an amount of from 1 part by weight to 50 parts by weight based on 100 parts by weight of said binder resin.

30. The heat fixing method according to claim 29, wherein said wax component is contained in said toner in an amount of from 5 parts by weight to 45 parts by weight based on 100 parts by weight of said binder resin.

31. The heat fixing method according to claim 15, wherein, at the time of the heat fixing of said toner image to said light-transmitting recording material, the heat fixing is carried out without applying oil to a fixing surface coming in contact with said toner image.

32. The heat fixing method according to claim 15, wherein, at the time of the heat fixing of said toner image to said light-transmitting recording material, the heat fixing is carried out while feeding oil to a fixing surface coming in contact with said toner image; said oil being applied in an amount not more than 0.04 mg/sheet (A4 size) on said light-transmitting recording material.

* * * * *

UNITED STATES PATENT AND TRADEMARK OFFICE

CERTIFICATE OF CORRECTION

PATENT NO. : 6,037,040
DATED : March 14, 2000
INVENTOR(S) : Takehiko Ohi, et al.

It is certified that error appears in the above-identified patent and that said Letters Patent is hereby corrected as shown below:

Column 1:
Line 13, "typicalfull-color" should read -- typical full –color --.

Column 2:
Line 35, "their" should read -- its --; and
Line 67, "melthed" should read -- melted --.

Column 4:
Line 45, "has" should read -- having --; and
Line 59, "DRAWING" should read -- DRAWINGS --.

Column 7:
Line 49, "Parkin" should read -- Perkin --.

UNITED STATES PATENT AND TRADEMARK OFFICE

CERTIFICATE OF CORRECTION

PATENT NO. : 6,037,040
DATED : March 14, 2000
INVENTOR(S) : Takehiko Ohi, et al.

It is certified that error appears in the above-identified patent and that said Letters Patent is hereby corrected as shown below:

Column 21:
Line 8, "was" should read -- were --.

Column 23:
Line 44, "$Ca_3$ $(PO_4)2$," should read -- $Ca_3(PO_4)_2$, --.

Column 24:
Line 22, "is" should read -- in --.

Column 26:
Line 1, manufacture" should read -- manufactured --.

Signed and Sealed this

Thirty-first Day of July, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,037,040
DATED : March 14, 2000
INVENTOR(S) : Takehiko Ohi et al.

It is certified that error appears in the above-identified patent and that said Letters Patent is hereby corrected as shown below:

Title page,
Item [56], References Cited, U.S. PATENT DOCUMENTS, "5,301,439" should read -- 5,302,439 --.
FOREIGN PATENT DOCUMENTS, INSERT:

| | | |
|---|---|---|
| -- 61-273554 | 12/1986 | Japan --; |
| -- 1-263085 | 10/1989 | Japan --; |
| -- 2-263642 | 10/1990 | Japan --; |
| -- 5-181300 | 7/1993 | Japan --; |
| -- 6-019180 | 1/1994 | Japan --; |
| -- 6-019485 | 1/1994 | Japan --; |
| -- -6-332221 | 12/1994 | Japan --; and |
| -- 7-199515 | 8/1995 | Japan --. |

Signed and Sealed this

Ninth Day of July, 2002

*Attest:*

*Attesting Officer*

JAMES E. ROGAN
*Director of the United States Patent and Trademark Office*